US005271480A

United States Patent [19]

Takegami

[11] Patent Number: 5,271,480

[45] Date of Patent: Dec. 21, 1993

[54] DEVICE FOR PROTECTING OXYGEN SENSOR OF MOTOCYCLE

[75] Inventor: Masaki Takegami, Iwata, Japan

[73] Assignee: Yamaha Hatsudoki Kabushiki Kaisha, Iwata, Japan

[21] Appl. No.: 893,253

[22] Filed: Jun. 3, 1992

[30] Foreign Application Priority Data

Sep. 11, 1991 [JP] Japan ..... 3-261039

[51] Int. Cl.[5] ..... B60K 13/04

[52] U.S. Cl. ..... 180/309; 180/219; 60/276

[58] Field of Search ..... 180/309, 68.3, 219, 180/225; 60/276, 289, 290, 293

[56] References Cited

U.S. PATENT DOCUMENTS 4,553,388 11/1985 Honda ..... 60/276

FOREIGN PATENT DOCUMENTS 6316117 1/1988 Japan .

0128787 5/1991 Japan ..... 180/309

OTHER PUBLICATIONS

Patent Abstracts of Japan vol. 008, No. 210(M-328) Sep. 26, 1984 & JP-A-59 099 021 (Honda) Jun. 7, 1984.

P.A. of Japan vol. 009, No. 142(M388) Jun. 18, 1985 & JP-A-60 022 017 (Yamaha) Feb. 4, 1985.

P.A. of Japan vol. 006, No. 056(M-121) Apr. 13, 1982 & JP-A-56 167 811 (Yamaha) Dec. 23, 1981.

*Primary Examiner*—Richard M. Camby

*Attorney, Agent, or Firm*—Ernest A. Beutler

[57] ABSTRACT

An exhaust system for a motorcycle that includes an exhaust sensor that extends into the exhaust system at a low point in the motorcycle. A plurality of baffles are positioned around the exhaust sensor so as to protect its extending portion from damage from foreign objects.

19 Claims, 6 Drawing Sheets

DEVICE FOR PROTECTING OXYGEN SENSOR OF MOTOCYCLE

BACKGROUND OF THE INVENTION

This invention relates to a device for protecting a sensor in the exhaust system of a vehicle and more particularly to a device for protecting an oxygen sensor of a motorcycle.

In order to improve the performance of internal combustion engines, it has been proposed to control the engine through one or more sensors that are positioned in the exhaust system of the engine. For example, it has been proposed to employ an oxygen sensor for sensing the amount of oxygen in the exhaust gases to determine the air/fuel ratio for the engine. The induction and charge forming system is then adjusted in response to the output of the oxygen sensor so as to maintain the desired fuel/air ratio under all running conditions.

In order to ensure good accuracy of the exhaust sensors, it is desirable to position them as close as possible to the cylinder. However, where multiple cylinders are employed, there is some advantage in placing the oxygen sensor in a common portion of the exhaust system, such as the exhaust silencer or muffler, so that the effect of cylinder to cylinder variations can be minimized. Although such arrangements are highly desirable, they provide certain problems in connection with the application to certain types of vehicles.

For example, in a motorcycle, it is the typical practice to have the running components such as the engine and portions of the exhaust system generally exposed. In addition, a common type of motorcycle layout places the engine in a transverse position in the motorcycle and the exhaust pipes extend from forwardly facing exhaust ports downwardly and then beneath the oil pan of the engine where the exhaust muffler is positioned. With such an arrangement, the sensor positioned in the muffler is exposed and can be easily damaged by foreign objects thrown up by the wheels of the motorcycle.

It is, therefore, a principal object of this invention to provide an improved exhaust sensor layout for a motorcycle.

It is a further object of this invention to provide an exhaust sensor layout for a motorcycle in which the exhaust sensor is well protected from foreign materials.

It is a further object of this invention to provide an improved exhaust sensor layout for a motorcycle wherein the exhaust sensor is well protected but wherein a flow of air may be permitted across the sensor for cooling purposes without permitting the sensor to be struck by foreign objects contained within the air stream.

SUMMARY OF THE INVENTION

This invention is adapted to be embodied in a motorcycle exhaust system comprising exhaust conduit means extending from an exhaust port of a motorcycle engine to a position low in the motorcycle and terminating at an atmospheric exhaust discharge. An exhaust sensor having a sensing portion is positioned within the exhaust conduit means and has a further portion that extends outwardly from the exhaust conduit means at a relatively low position in the motorcycle. In accordance with the invention, baffle means are positioned contiguous to the sensor further portion for protecting the exhaust sensor from damage from foreign objects.

DETAILED DESCRIPTION OF THE PREFERRED EMBODIMENTS OF THE INVENTION

Figure 1:
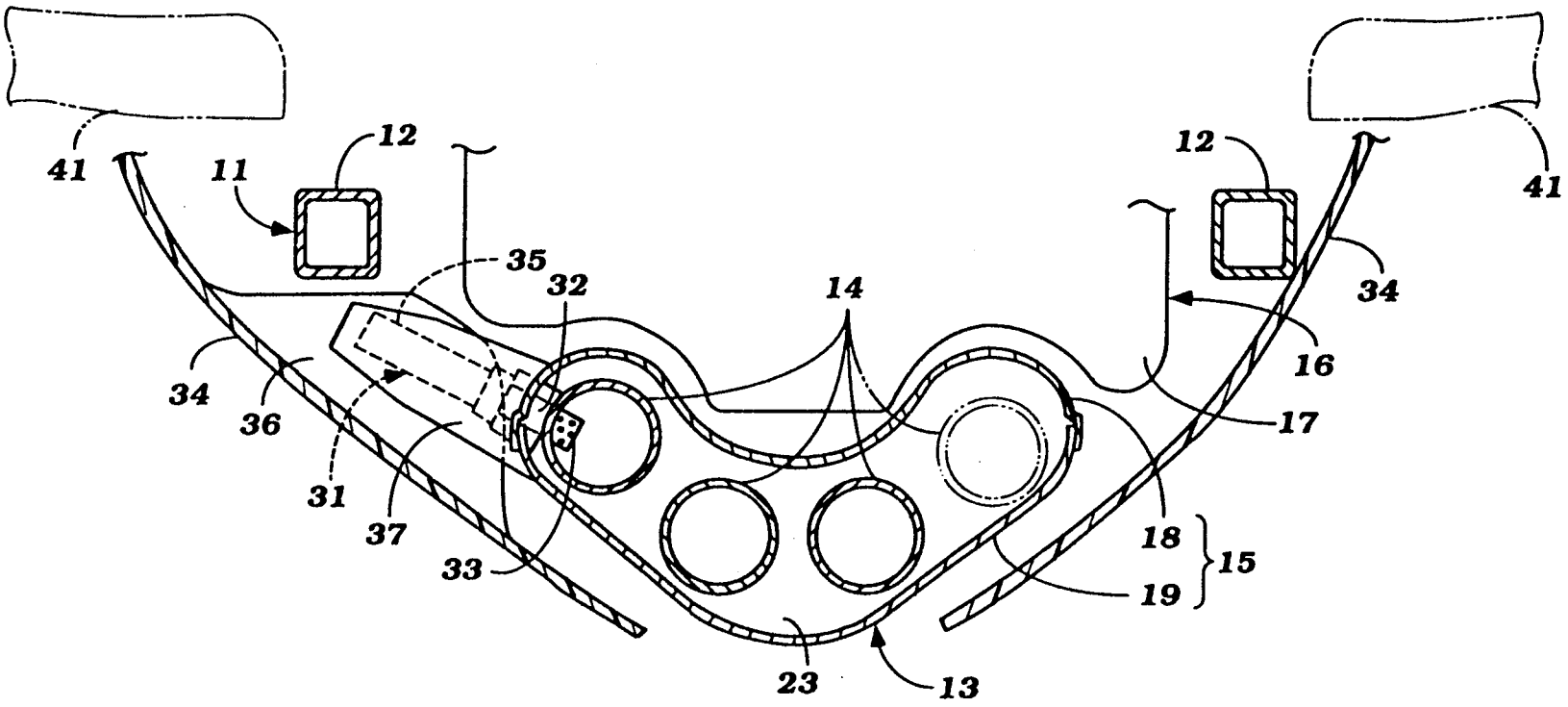
FIG. 1 is a transverse cross-sectional view taken through the lower portion of a motorcycle having an exhaust system constructed in accordance with a first embodiment of the invention and taken generally along the line 1—1 of FIG. 2.

Before referring in detail to the drawings, it is to be understood that the invention is adapted to be embodied in a motorcycle or a motorcycle type vehicle that is comprised of a frame assembly having at least a dirigible front wheel and a driven rear wheel. A powering internal combustion engine is supported in the frame assembly and drives at least the one driven rear wheel in any suitable manner. Because the invention may be employed with any conventional motorcycle type of vehicle, the details of the complete vehicle have not been illustrated. Reference may be had, however, to FIG. 1 of the co-pending application entitled "Oxygen Sensor Layout," U.S. Ser. No. 834,472 filed Feb. 12, 1992 in the name of Ryoichi Gekka and assigned to the Assignee hereof, for the details of a typical type of motorcycle construction with which the invention may be utilized. The disclosure of that application is herein incorporated by reference.

Since the invention deals with the portion of the exhaust system for the motorcycle which lies at the lower portion of the motorcycle and in which the oxygen sensor is positioned, only that portion of the motorcycle has been illustrated in the accompanying drawings and will be described. It should be readily apparent, however, how the invention can be utilized with complete vehicles of the known types.

Figure 2:
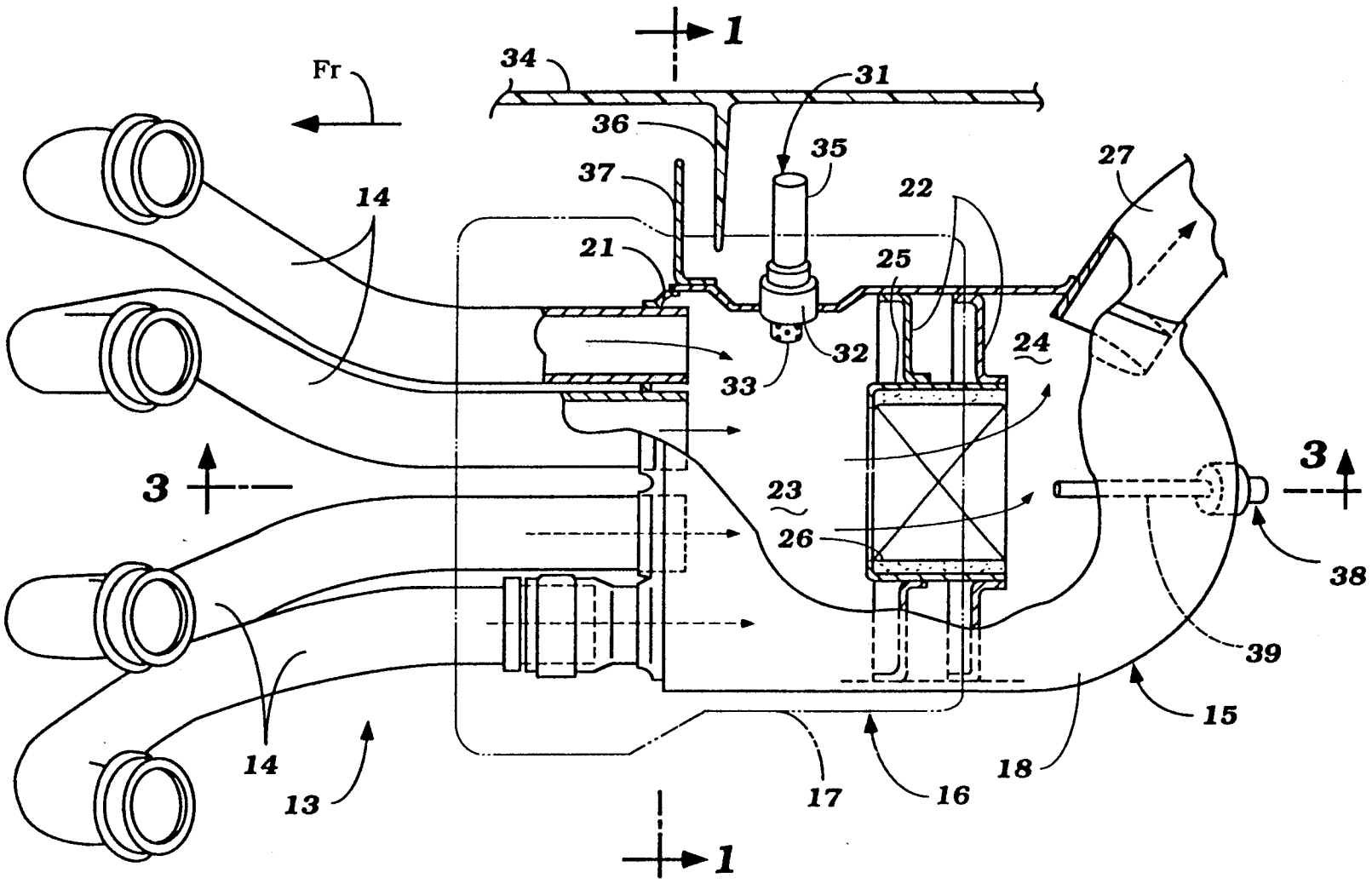
FIG. 2 is a top plan view of the portion of the motorcycle shown in FIG. 1, with portions broken away so as to more clearly show the construction.
Figure 3:
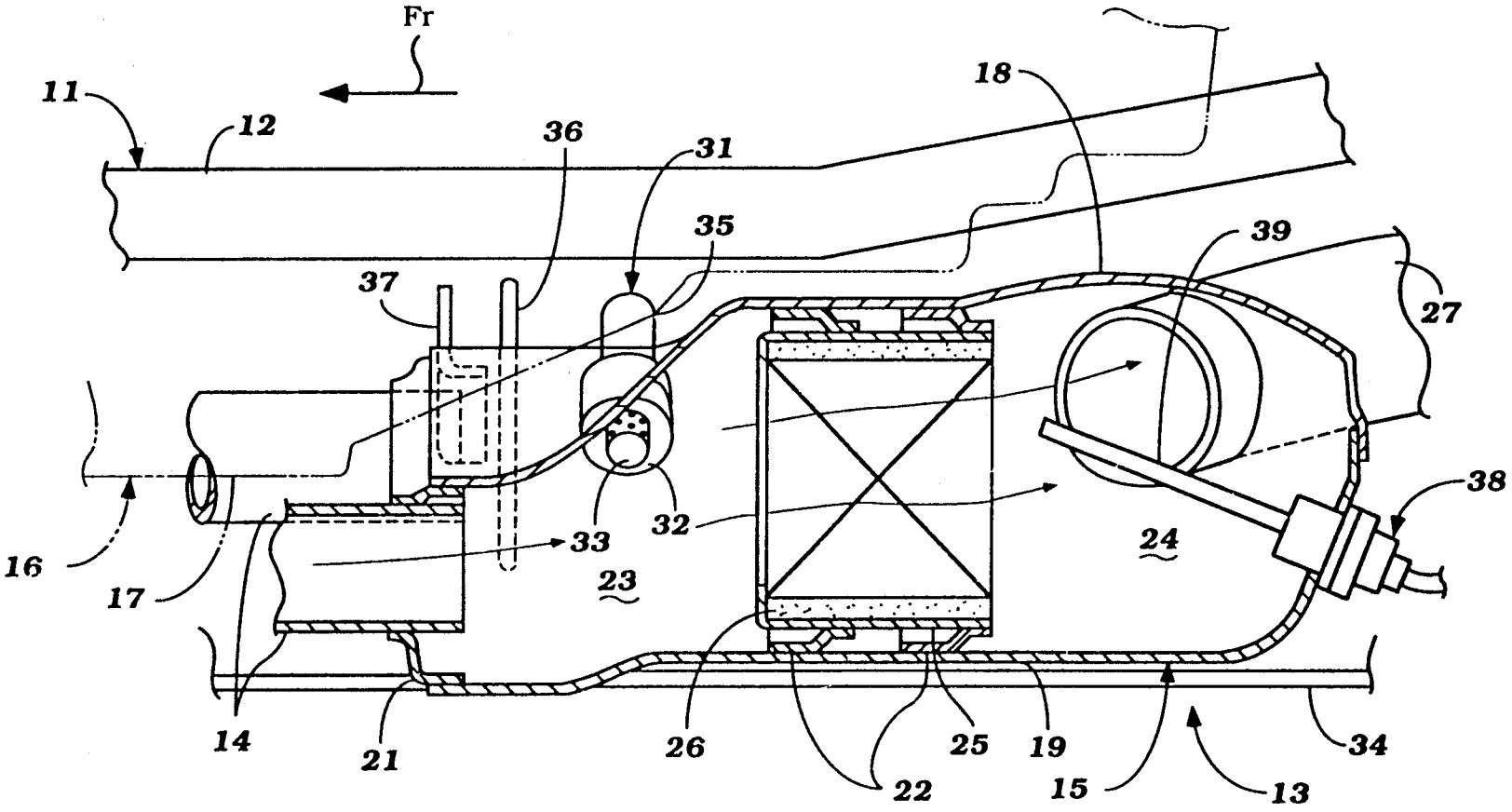
FIG. 3 is a cross-sectional view taken along the line 3—3 of FIG. 2.

Referring first to the embodiment of FIGS. 1-3 only the lower portion of the motorcycle between the front and rear wheels has been illustrated. The motorcycle is comprised of a frame assembly, indicated generally by the reference numeral 11, that includes a pair of tubular spaced apart down tubes 12 which extend generally horizontally and which are formed at the lower portion of down tubes which are connected at their upper ends to a head pipe (not shown) that journals a front fork and front wheel assembly for dirigible motion in a known manner. An engine (later illustrated in part) is disposed transversely in the frame assembly 11 for driving the rear wheel (not shown) of the motorcycle in a known manner. In the illustrated embodiment, the associated engine is of the four cylinder in-line type. As is typical with motorcycle practice, the engine is disposed so that its crank shaft rotates about a transversely extending axis and so that its exhaust ports face forwardly.

The engine is provided with an exhaust system, indicated generally by the reference numeral 13, which includes four individual exhaust pipes 14 that are connected at their upper ends to the exhaust ports and which extend forwardly, then downwardly and curve rearwardly at a point low in the frame assembly and beneath the lower ends of the down tubes 12. The exhaust pipes 14 merge into an exhaust device, indicated generally by the reference numeral 15 and which is, in the illustrated embodiment, a combined silencer and catalytic converter.

The exhaust device 15 is positioned beneath the engine, which is shown partially in the figures and is identified generally by the reference numeral 16, and specifically beneath the crankcase 17 thereof. The exhaust device 15 is formed from sheet metal stampings and is comprised of an upper stamping 18 and a lower stamping 19 that have overlapping end portions that are affixed to each other, as by welding. These sections 18 and 19 have affixed to them a forward wall 21 so as to define an enclosed volume.

The exhaust pipes 14 extend through the front wall 21 and deliver exhaust gases to the internal cavity of the exhaust device 15. One of the exhaust pipes 14 has a slip fit to the exhaust device 15 and specifically its front wall 21, while the remaining exhaust pipes are rigidly affixed thereto to form a unitary assembly as noted in the aforenoted co-pending U.S. application Ser. No. 834,472.

A pair of baffles 22 are affixed internally of the exhaust device 15 and divide it into a front chamber 23 and a rear chamber 24. The exhaust pipes 14 deliver exhaust gases to the chamber 23 as shown by the arrows in the figures. The baffles 22 support a tubular shell 25 of a catalyzer device that includes a catalytic material 26 that extends around the hollow interior of the shell 25. As a result of this construction, exhaust gases flowing from the chamber 23 to the chamber 24 will come in contact with the catalytic material 26 and the exhaust gases can be treated in a suitable manner depending upon the type of catalyzer employed.

A tail pipe 27 is affixed in the rear portion of the exhaust device 15 and specifically the upper shell portion 18 and discharges the exhaust gases to the atmosphere at one side of the rear wheel. If desired, a further muffler or silencing device may be provided in the tail pipe 27.

In order to further control the emission of unwanted exhaust gas constituents, a feedback control system is provided for controlling the air/fuel ratio supplied to the engine by its charge former. For example, this may be done with fuel injected engines by varying the timing and duration of fuel injection. This control device includes an oxygen sensor, indicated generally by the reference numeral 31, and which has a mounting portion 32 that is affixed to the exhaust device 15 so that its sensor probe 33 will extend into the forward chamber 23. It is desirable to position the oxygen sensor 31 so that its probe 32 will be positioned as closely as possible to the exhaust ports of the engine. This is to ensure an accurate reading of the fuel/air ratio. However, if the oxygen sensor 31 is positioned directly in one of the exhaust pipes 14, it will sense cylinder variations of only this one cylinder. Therefore, it is desirable to provide the sensor 31 in the exhaust device 15 so that it will read the average fuel/air ratio for all cylinders.

However, this type of location places the oxygen sensor 31 at a low portion of the motorcycle as clearly shown in FIG. 1 and wherein it can be subject to damage by foreign material thrown up by the wheels of the motorcycle. Also, there is a danger that the sensor 31 could contact the ground on excessive leaning.

To avoid these problems and in accordance with an important feature of the invention, the oxygen sensor is protected by a baffling arrangement which includes one of two lower body panels 34 which may be formed from a suitable material such as a rigid resinous plastic and which are affixed to the frame assembly 11 in a suitable manner and which extend downwardly therealong and in overlapping proximity to the lower sides of the exhaust device lower shell 19. It should be noted that the oxygen sensor is disposed so that its projecting portion 35, to which an electrical lead is fastened, extends generally parallel to the body panel 34.

In addition, the panel 34 on the side where the oxygen sensor 31 is positioned is provided with an upstanding or perpendicular baffle 36 which extends forwardly of the oxygen sensor and particularly its portion 35 so as to clearly protect it from damage from foreign objects. In addition, the baffle 35 adds to the rigidity of the body panel 34.

In order to provide further protection, a further baffle 37 is fixed directly to the exhaust device 15 in the area where the shell portions 18 and 19 overlap to add further rigidity to the shell portions 18 and 19 and to provide a labyrinthine air flow path, as clearly shown in FIG. 2, so that any foreign objects in the air path will be excluded but wherein air flow is permitted across the sensor 31 and specifically its portion 35 for cooling purposes.

A temperature probe, indicated generally by the reference numeral 38 is mounted at the rear portion of the exhaust device 15 and has a thermocouple 39 that extends into the rear chamber 24 so as to effectively sense the temperature of the exhaust gases. The temperature probe 38 also outputs a signal to a CPU which receives the signal from the oxygen sensor 31 and provides control over the air/fuel ratio, as aforenoted.

The motorcycle is also provided with a pair of foot pegs 41 on which the operator may rest his feet and these foot pegs are generally aligned with the location of the oxygen sensor 31.

Figure 4:
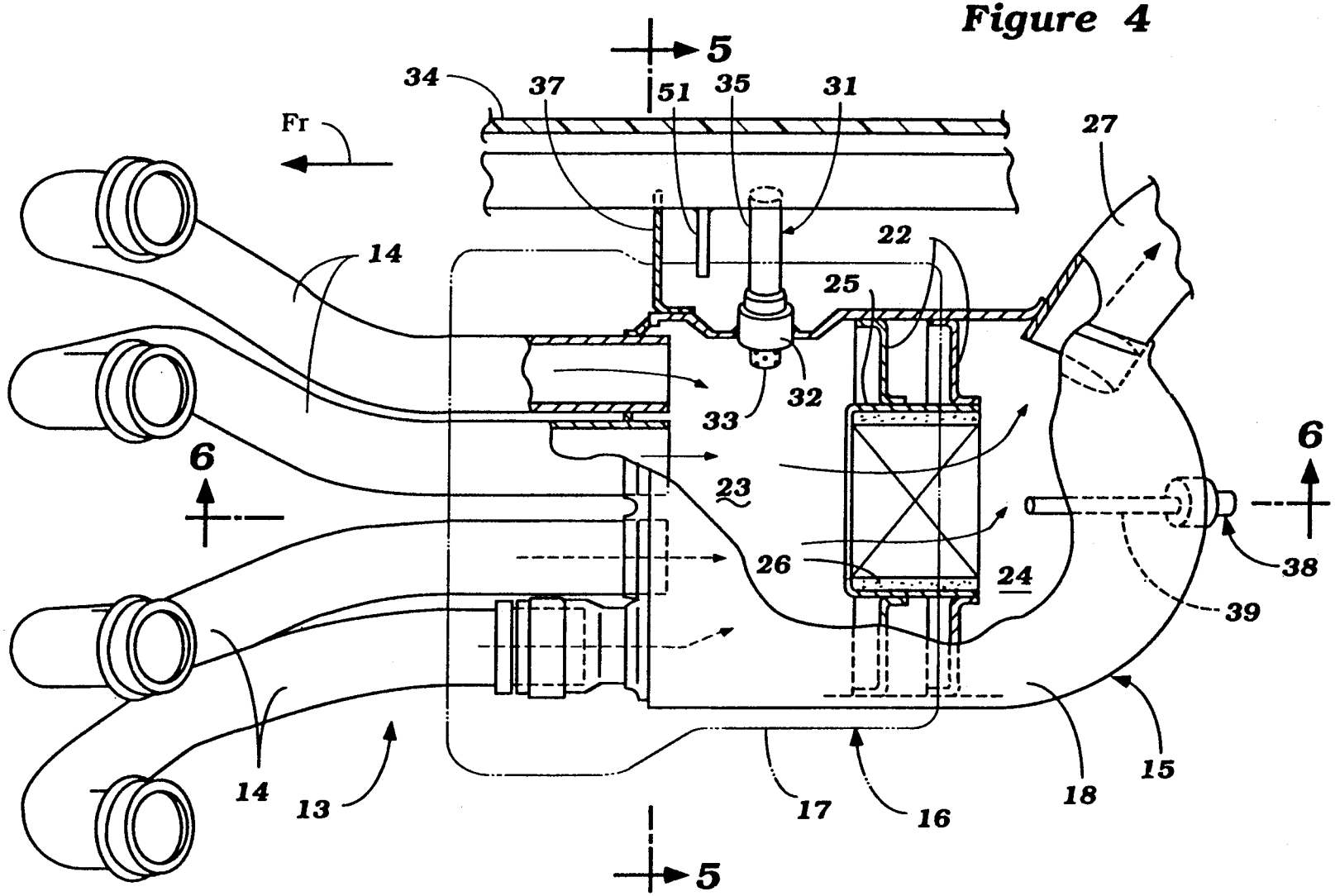
FIG. 4 is a top plan view, in part similar to FIG. 2, and shows another embodiment of the invention.
Figure 5:
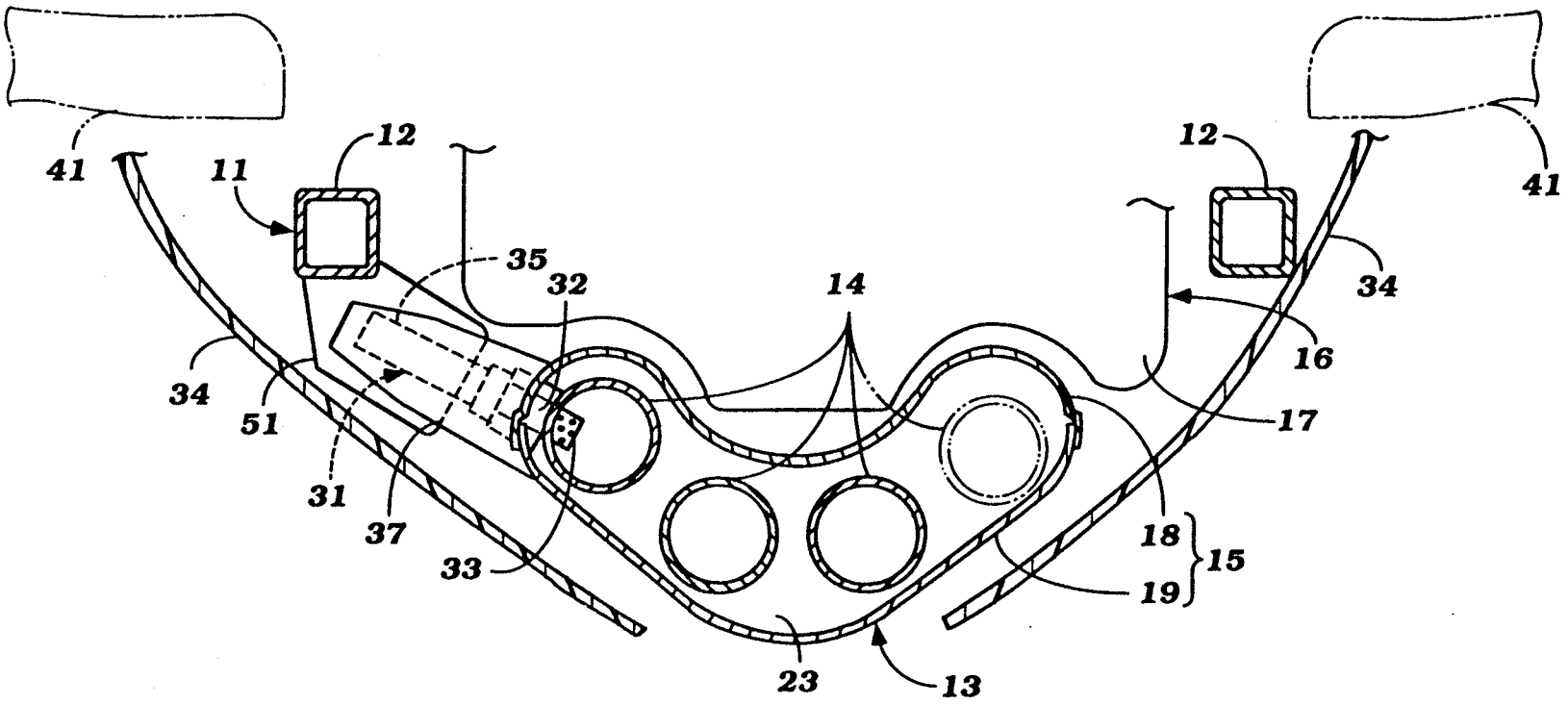
FIG. 5 is a cross-sectional view taken along the line 5—5 of FIG. 4 and is in part similar to FIG. 1.
Figure 6:
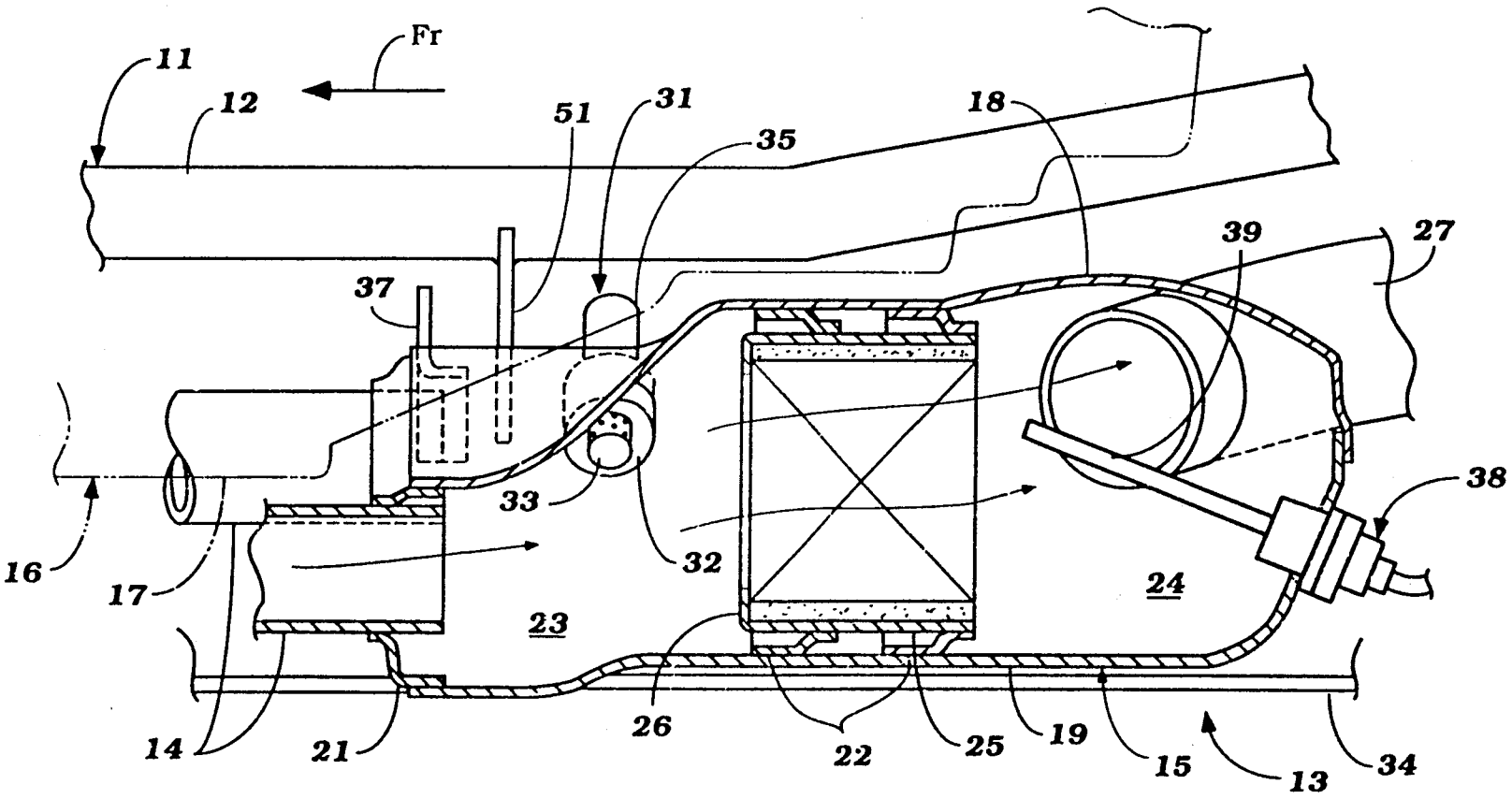
FIG. 6 is a cross-sectional view taken along the line 6—6 of FIG. 4 and is in part similar to FIG. 3.

FIGS. 4–6 show another embodiment of the invention which is generally similar to the embodiment of FIGS. 1–3 and, for that reason, components of this embodiment which are the same or substantially the same as the previously described embodiment have been identified by the same reference numerals and will not be described again in detail. In this embodiment, the body panel 34 adjacent the oxygen sensor 31 is not provided with a baffle. Rather, a baffle 51 is affixed to the down tube 12 and extends in the same location as the baffle 36 of the previous embodiment. Thus, this embodiment also provides the full protection for the oxygen sensor 31 without limiting the air flow which will be effective to cool it while at the same time, excluding foreign particles from the air flowing.

It should be noted that in each of the embodiments, the combination of the body panel and baffles protect the oxygen sensor 31 from the bottom and forward portion. The top of the oxygen sensor 31 is disposed immediately beneath the crankcase 17 and hence it will be protected in an upward direction by the crankcase. Therefore, each embodiment is extremely effective in providing good protection for the oxygen sensor. Of course, the invention may be employed for protecting other types of exhaust sensors than oxygen sensors, such as the temperature sensor. Of course, the foregoing description is that of preferred embodiments of the invention and various changes and modifications may be made without departing from the spirit and scope of the invention, as defined by the appended claims.

I claim:

1. A motorcycle exhaust system comprising exhaust conduit means extending from an exhaust port of a motorcycle engine to a position low in the motorcycle extending at least in part beneath the engine and terminating at an atmospheric exhaust, an exhaust sensor having a sensing portion positioned within said exhaust conduit means at a position below the engine and a further position extending transversely outwardly from a side of said exhaust conduit means at a relatively low position in said motorcycle and beneath the engine, and baffle means positioned contiguous to said sensor further portion for protecting said exhaust sensor from damage from foreign objects.

2. A motorcycle exhaust system as set forth in claim 1 wherein the baffle means comprise a plurality of baffles.

3. A motorcycle exhaust system as set forth in claim 2 wherein the plurality of baffles define a labyrinthine flow path for air across the sensor to cool the sensor while precluding the passage of foreign objects to the sensor.

4. A motorcycle exhaust system as set forth in claim 1 wherein the baffle means includes a first baffle portion lying beneath the exhaust sensor further portion and a second baffle portion extending forwardly of the exhaust sensor further portion.

5. A motorcycle exhaust system as set forth in claim 4 wherein the baffles are formed by a common member.

6. A motorcycle exhaust system as set forth in claim 5 wherein the common member is a body panel for further providing an extension of a body of a motorcycle.

7. A motorcycle exhaust system as set forth in claim 4 wherein the exhaust sensor further portion extends in a direction generally parallel to the lower baffle portion.

8. A motorcycle exhaust system as set forth in claim 4 wherein the baffle means comprise a plurality of baffles.

9. A motorcycle exhaust system as set forth in claim 1 wherein the exhaust conduit means is comprised of an exhaust device containing at least one of a silencing device and a catalyzer and formed from an upper shell member and a lower shell member affixed to each other around their periphery.

10. A motorcycle exhaust system as set forth in claim 9 wherein the baffle means comprise a plurality of baffles.

11. A motorcycle exhaust system as set forth in claim 10 wherein the plurality of baffles define a labyrinthine flow path for air across the sensor to cool the sensor while precluding the passage of foreign objects to the sensor.

12. A motorcycle exhaust system as set forth in claim 9 wherein the baffle means includes a first baffle portion lying beneath the exhaust sensor further portion and a second baffle portion extending forwardly of the exhaust sensor further portion.

13. A motorcycle exhaust system as set forth in claim 12 wherein the baffles are formed by a common member.

14. A motorcycle exhaust system as set forth in claim 13 wherein the common member is a body panel for further providing an extension of a body of a motorcycle.

15. A motorcycle exhaust system as set forth in claim 12 wherein the exhaust sensor further portion extends in a direction generally parallel to the lower baffle portion.

16. A motorcycle exhaust system as set forth in claim 12 wherein the baffle means comprise a plurality of baffles.

17. A motorcycle exhaust system as set forth in claim 9 wherein the exhaust device is comprised of at least one inlet pipe entering into one end thereof, a baffle positioned in confronting relationship to said exhaust pipe and defining a cavity therebetween, said exhaust sensor sensing portion being disposed in said cavity.

18. A motorcycle exhaust system as set forth in claim 17 wherein there are a plurality of exhaust pipes opening into the outer shell in confronting relationship with the baffle.

19. A motorcycle exhaust system as set forth in claim 18 further including a catalyzer contained within said outer shell to the rear of said cavity.

* * * * *